US006519776B1

(12) United States Patent
Davenport et al.

(10) Patent No.: US 6,519,776 B1
(45) Date of Patent: Feb. 18, 2003

(54) GOLF BALL MARKER FOR USE WITH GOLF GLOVE

(75) Inventors: Lanier M. Davenport, Lookout Mountain, TN (US); Dennis Knight, Ringgold, GA (US)

(73) Assignee: International GLUV Corporation, Chattanooga, TN (US)

( * ) Notice: Subject to any disclaimer, the term of this patent is extended or adjusted under 35 U.S.C. 154(b) by 0 days.

(21) Appl. No.: 10/056,283

(22) Filed: Jan. 24, 2002

Related U.S. Application Data

(63) Continuation-in-part of application No. 10/021,451, filed on Oct. 29, 2001.

(51) Int. Cl.[7] ..... A41D 19/00
(52) U.S. Cl. ..... 2/161.2; 2/161.1
(58) Field of Search ..... 2/16, 20, 159, 2/160, 161.1, 161.2, 161.4, 161.5, 162; 24/114.9, 107, 108; 63/29.1; 224/918; 473/205, 406

(56) References Cited

U.S. PATENT DOCUMENTS 4,489,444 A * 12/1984 Graham ..... 2/160
4,639,947 A * 2/1987 Lanscioni ..... 2/161.5
5,365,609 A * 11/1994 Herzog ..... 2/161.4
5,795,248 A * 8/1998 Giglio ..... 473/406
5,996,116 A * 12/1999 Tate ..... 2/12
6,014,775 A * 1/2000 Missry ..... 2/161.2
6,163,889 A * 12/2000 Tate ..... 2/209.13
6,170,088 B1 * 1/2001 Tate ..... 2/209.13

* cited by examiner

*Primary Examiner*—Gary L. Welch
(74) *Attorney, Agent, or Firm*—Alan Ruderman; Stephen J. Stark; Miller & Martin LLP

(57) ABSTRACT

A golf ball marker for use with a golf glove including a tab which spans a slit on a back portion of the glove. A top surface of a ball marker is substantially flush with a ridge on the tab. A rubber insert having a hole therein receives a back surface of the ball marker within a recessed portion defined within the ridge. A socket is located within the hole of the rubber insert to receive a prong which is connected to the back surface of the ball marker. The ball marker is formed with a recess in the bottom surface to receive a base of a stud member so that the stud extends away from the bottom surface of the ball marker and the interfacing surface of the base is substantially parallel to the bottom surface of the ball marker.

20 Claims, 2 Drawing Sheets

GOLF BALL MARKER FOR USE WITH GOLF GLOVE

This application is a continuation-in-part application of pending U.S. patent application Ser. No. 10/021,451 filed Oct. 29, 2001.

FIELD OF THE INVENTION

The invention relates to golf ball markers, and more particularly a ball marker adapted to be removably attached to a golf glove.

BACKGROUND OF THE INVENTION

Golf ball markers and gloves of various designs have been manufactured for many years. Most golf gloves have a slit or spacing between two sections extending along the back of the glove and thus along the back of a user's hand which allows the user the ability to insert his or her hand into the golf glove with the fingers in the finger portions of the glove by spreading or opening the slit. Once the fingers are in position, the glove is then tightened about the user's hand by pulling the two sections together and securing the glove such as by a connecting tab extending between the sections across the slit. The tab is usually sewn to one section at one side of the slit and may utilize a hooks and loops connection, with one of the hooks or loops connected to the tab and the other connected to the glove at the section at the other side of the slit. Accordingly, the tab may be pulled to close the slit and the connection made between the sections to secure the glove to fit about the user's hand.

A number of years ago, golf glove manufacturers began to provide removable ball marker attached to the golf glove. These removable markers operate in a similar as "snap" connectors in clothing. The glove is equipped with the female connection portion, or socket, and the marker has a cooperating male fitting, or stud, on its back. The female connector is almost always located at the base of the glove near the wrist of the user and is usually located close to the slit and on the side of the slit where the tab is sewn to the glove near the wrist of the user at the small finger side of the glove. This position for some golfers may be somewhat awkward.

Moreover, in the traditional snap construction, a prong member is placed within the glove and the barbs extend through the glove. The socket member is then placed on top of the barbs and pressure is applied to secure the prong to the socket. The socket remains extending a distance beyond the outside surface of the glove. Accordingly, when the stud member is connected to the socket member, it also extends a distance beyond the exterior glove surface along with the connected ball marker. Because the ball marker extends in an unprotected manner with its bottom surface exposed above an exterior surface of the glove, it may get snagged on clothing or other items. This could result in a number of problems for the golfer including the possible inadvertent and unknowing loss of the ball marker.

Tate, U.S. Pat. Nos. 5,996,116, 6,163,889, and 6,170,088, forgoes the traditional prong and socket connection. Tate utilizes magnets to connect ball markers to clothing, including to golf gloves. While the use of magnetically retained golf ball markers is not widespread, the Tate patents show that a need exists to improve upon the traditional ball marker connection system.

SUMMARY OF THE INVENTION

An object of the invention is to provide a detachable ball marker for use with a golf glove, preferably attachable on the connecting tab and protected in an advantageous configuration.

Another object of the invention is to provide a ball marker of advantageous construction and design.

Accordingly, a golf ball marker preferably has a plug illustrated as a disc shape like a coin. The disc may be stamped out in quantity. Located at the center of the disc is a cylindrical recess which does not extend the thickness of the disc. A prong connector member is then inserted into the recess to where the base of the prong connecter coincides with the recess and a bottom surface of the base is substantially parallel, and preferably coplanar, with a bottom surface of the disc. The prong then appears to extend from a bottom surface of the disc. The base is preferably soldered in place.

The golf glove includes a tab has a removable ball marker connected thereto. A top surface of a ball marker preferably is substantially flush with a ridge on the tab. The ridge extends a distance above an exterior surface of the tab. A rubber insert having a hole therein receives a back surface of the ball marker within a recess defined within the ridge. The rubber insert preferably includes a retainer, or a surrounding protector, about the ball marker. A socket is located within the hole of the rubber insert to receive a prong which is connected to the back of the ball marker.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 2:
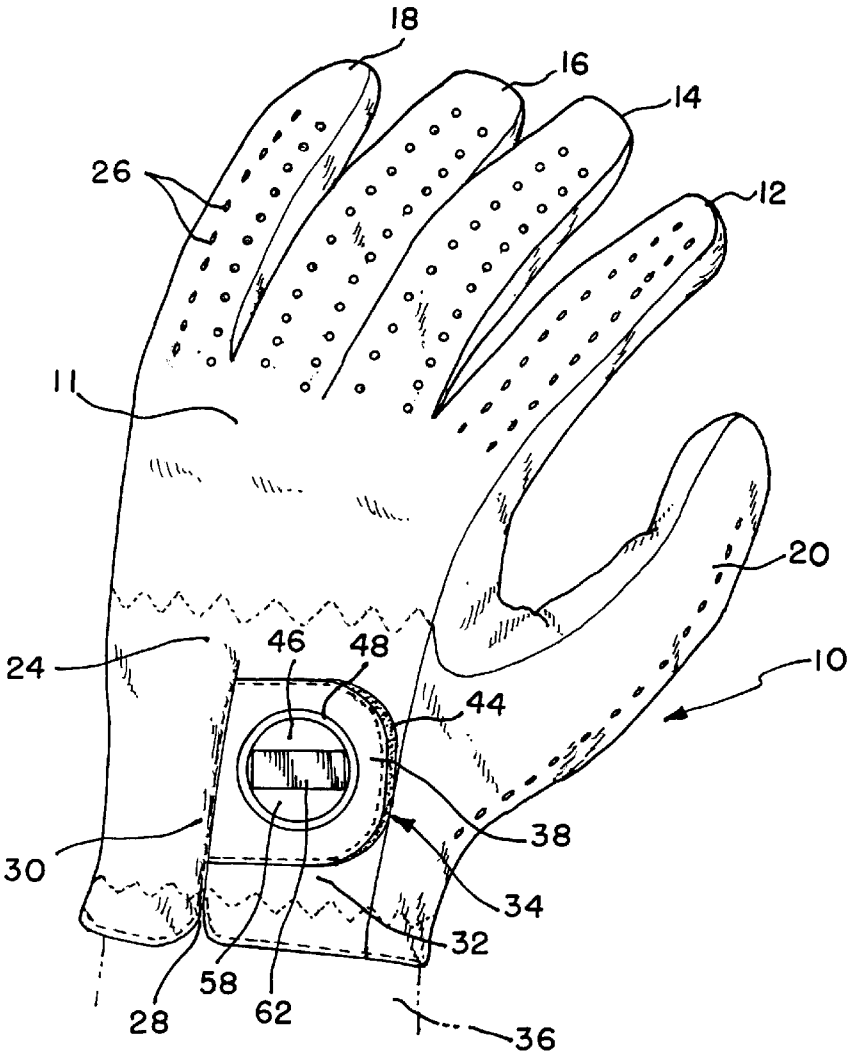
FIG. 2 is a back elevational view of the glove of FIG. 1.
Figure 1:
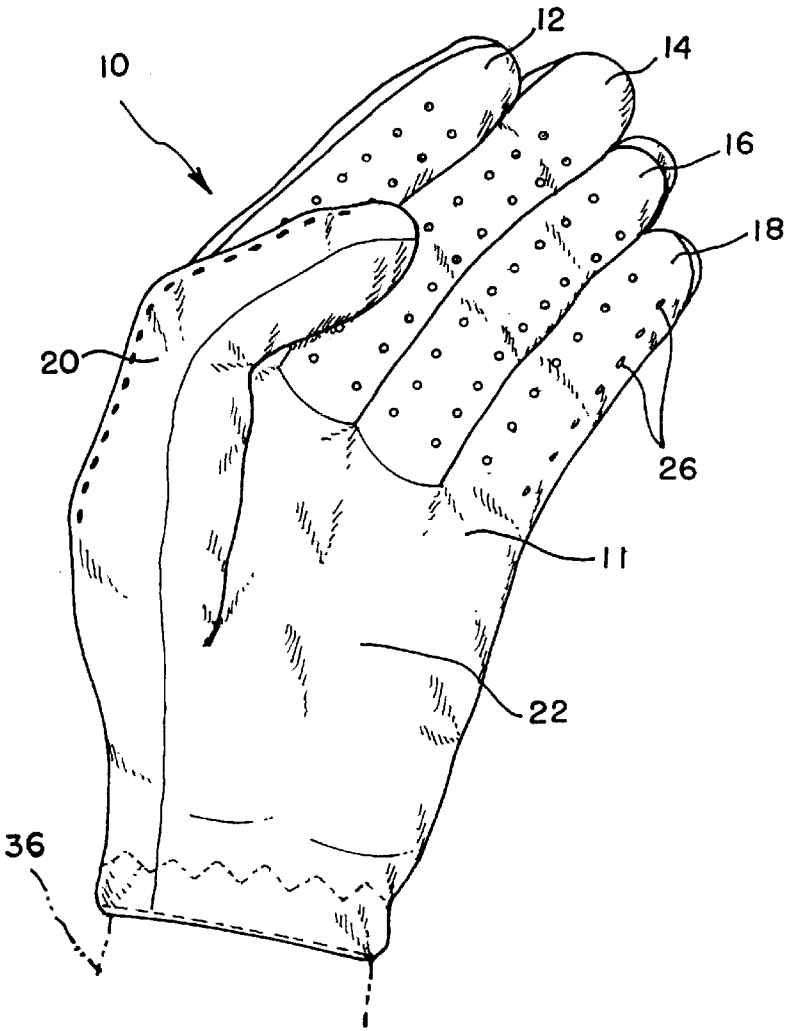
FIG. 1 is a front elevational view of a glove constructed in accordance with the invention.

FIGS. 1 and 2 show the preferred embodiment of a golf glove 10 having a covering 11 with four fingers 12,14,16,18, thumb 20, a palm portion 22 and a back portion 24. Although complete fingers 12,14,16,18 and thumb 20 are illustrated, fingertips, or other portions of the digits could be exposed through openings 26 or otherwise. Additionally, the illustrated golf glove 10 has been constructed in a Gunn cut fashion. Other golf glove construction techniques could also be utilized.

Regardless of the style of golf glove utilized, the golf glove 10 includes a back portion 24 which connects to the palm portion 22 and is opposite to the palm portion 22, extending along a back of a golfer's hand when worn. The back portion 24 usually has a slit 28 which separates a first back section 30 from a second back section 32. Although the slit 28 is illustrated centered on the back portion 24, this need not necessarily be the case. The slit 28 could even begin on the palm portion 22 and extend to the back portion 24. Other designs may include elastic webbing between the first and second back sections 30,32 or otherwise allow for the displacement of the first and second back sections 30,32 relative to one another so that the slit 28 may not be present in all golf glove designs.

When utilized, the edges of the slit 28 are typically spread apart to allow the golfer to put the golf glove 10 on his or her hand as illustrated in FIGS. 1 and 2. After putting the golf glove 10 on the hand, the first back section 30 is brought towards the second back section 32. This may be done by pulling on tab 34. This provides a "fit" of the golf glove 10 about the golfer's wrist 36, and hand, as illustrated. The tab 34 is illustrated connected to the first back section 30 by being sewn to the first back section 30. Of course there are other techniques known in the art that can be utilized to connect the first back section 30 and the tab 34.

Figure 3:
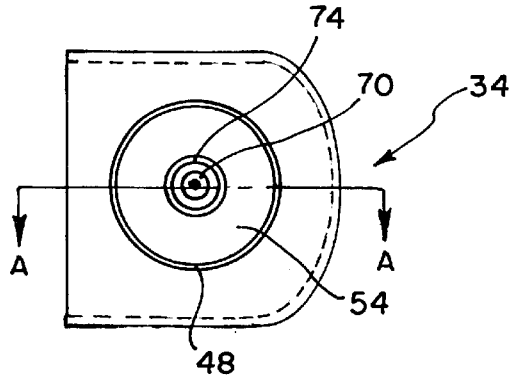
FIG. 3 is a view of the tab shown in FIG. 2 with the detachable ball marker removed.
Figure 4:
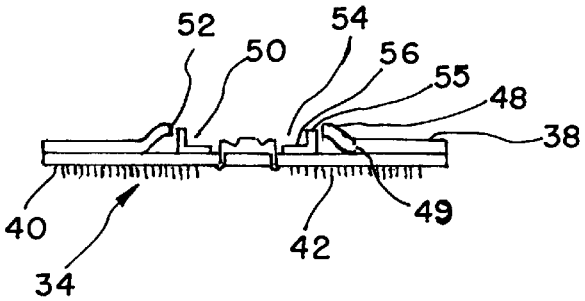
FIG. 4 is a cross sectional view along line A—A of FIG. 3.

The tab 34 has an exterior surface 38 shown in FIGS. 2, 3 and 4 and an interior surface 40 shown in FIG. 4. The tab 34 also has a first connector portion 42 shown in FIG. 4 which cooperates with second connector portion 44 shown in FIG. 2 on the second back section 32. In the preferred embodiment illustrated, the connector portions 42,44 are loops and hooks, respectively. The hooks and loops connection is commonly utilized to provide a detachable, and then reattachable connection for golf glove tabs. Other first and second connector portions 42,44 known in the art may also be utilized.

FIG. 2 shows a ball marker 46 connected to the tab 34 of the golf glove 10, while FIGS. 3 and 4 show the tab 34 with the ball marker 46 removed. Referring primarily to FIGS. 3 and 4, the exterior surface 38 of the tab 34 has a ridge 48 which is located a distance above, or beyond, the exterior surface 38 of the tab 34, as well as a distance above a first recessed portion 50, or well. Preferably, the ridge 48 surrounds the recessed portion 50 as illustrated and may be at least partially defined by stitching 49. Ridge walls 52 extend at least partially from the ridge 48 into the recessed portion 50. An insert 54, such as rubber insert illustrated, provides a resting surface 56 for receiving the ball marker 46 when it is connected to the golf glove 10. The insert 54 or another component provides a retainer 55, illustrated as a ring which surrounds edges of the marker when installed. The retainer 55 may protect the ridge walls 52 from wear during the life of the glove 10, and may or may not contact the marker 46 when the marker 46 is installed on the glove 10.

Figure 7:
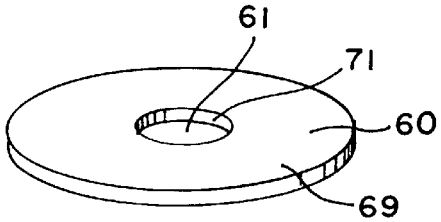
FIG. 7 is an elevational view of the bottom surface of a ball marker during the construction process.
Figure 5:
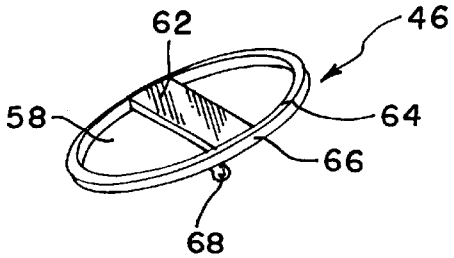
FIG. 5 is a side perspective view of a ball marker removed from the glove of FIG. 2.
Figure 10:
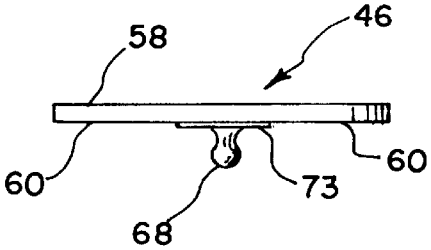
FIG. 10 is a side plan view of the ball marker of FIG. 9.
Figure 6:
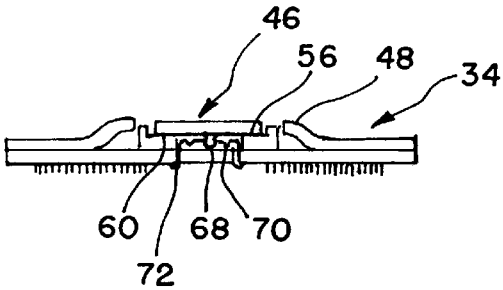
FIG. 6 is the cross sectional view of FIG. 4 with the ball marker connected to the tab.

FIG. 5 shows a ball marker 46 having an upper surface 58, the lower surface 60 is obscured from view in FIG. 5 but is visible in FIGS. 6, 7, and 10. The upper surface 58 has been stamped or embossed with a bar 62 which is representative of a design, logo, trademark, name or indicia which may be provided on a ball marker 46. The bar 62 may be raised to extend a distance above the upper surface 58 of the ball marker 46, level with or recessed a distance below the upper surface 58. A rim 64 may also extend a distance above or below the upper surface 58 of the ball marker 46. A side surface 66 is shown extending at least partially around a perimeter of the ball marker 46. Although the marker 46 is shown as flat and substantially cylindrical other geometric shapes may be appropriate for some designs.

Figure 8:
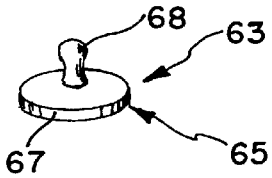
FIG. 8 is an elevational view of a prong connector apart from the ball marker.
Figure 9:
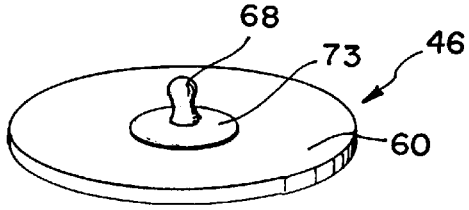
FIG. 9 is an elevational view of the ball marker of FIG. 7 with the prong connector of FIG. 8 connected.

A stud 68 extends from the lower surface 60 of the ball marker 48. The stud 68 may be integrally formed with the ball marker 48, or more preferably, is connected to the lower surface 60. When connecting the stud 68 to a plug 69 which forms the upper surface 58 and lower surface 60, it is preferable to form a plug 69 having a recess 61 illustrated as a cylindrical recess. Plugs 69 are often formed in stamping operations in a similar fashion as stamping out coins. A stud member 63 having a base 65 shown in FIG. 8 is then placed so that at least a portion of the base 65 is contained within the recess 61. A stud 68 extends from the base 65. The base 65 preferably has a perimeter 67 which cooperates with sides 71 of the recess 61 so that the base 65 appears to be a portion of the plug 69 when installed as shown in FIG. 9. The base 65 may then be soldered in place.

The base 65 has an interfacing surface 73 and an opposed surface (obscured from view). It is preferable for the interfacing surface 73 of the base 65 to be parallel to the bottom surface 60 of the marker 46. It is further preferred that the interfacing surface 73 be substantially coplanar with the bottom surface 60. This allows the stud 68 to connect with the socket 70 with the bottom surface 60 contacting the resting surface 56 of the insert 54. Since the insert 54 is preferably a resilient material, such as rubber, it bends upon application of force to allow a user to access an edge of the marker 46 to then remove the marker 46 from the glove 10.

The stud 68 is a third connector portion which at least assists in retaining the ball marker 48 connected to the golf glove 10. Other third connector portions could include the side surface 66 contacting the ridge wall 52 or retainer 55, or any other connection technique known in the art that would allow for detachment and subsequent reattachment, including magnets or other connector portions.

The third connector portion, illustrated as stud 68, preferably cooperate with fourth connector portion, illustrated as socket 70 in FIGS. 3,4, and 6. The socket 70 is retained in position utilizing prong member 72 as is known in the art. Other fourth connector portions which cooperate with the third connector portion including magnets or other devices could be utilized. In that case, the insert 54 may be a magnet and function as the fourth connector portion.

The insert 54 preferably includes a second recessed portion 74, illustrated as a hole in the insert 54. This allows the resting surface 56 to be at, or above the fourth connector portion, or socket 70, illustrated. Accordingly, as illustrated in FIG. 6, the lower surface 60 of the ball marker can rest against the resting surface 56 when the third and fourth connector portions are connected. Additionally, the lower surface 60 of the ball marker 46 is located below the ridge 48. The upper surface of the ball marker 46 is also preferably located at or below the ridge 48. Furthermore, the bar 62, or the tallest portion of the ball marker 62, whichever is taller, is shown in FIG. 6 as being located at or below the ridge 48 when the ball marker 46 is connected to the tab 34. By locating the lower surface 60 below the ridge 48, it is less likely that the ball marker 46 may be snagged inadvertently and lost. By locating the upper surface 58 at or below the ridge 48, there is even less of an opportunity to inadvertently disconnect the ball marker 46 from the glove 10.

The side surface 66 of the ball marker 46 preferably abuts, adjoins, or is at least located close, to the ridge wall 52. Very little, if any of the insert 54 is preferably visible. This construction has been found to provide a professional configuration. Accordingly, the perimeter of the ball marker 46 is proximate to a perimeter of the ridge 48.

By utilizing standard third and fourth connector portions are utilized, such as studs 68 and sockets 70, i.e., male and female couplers, ball markers 46 may be sold independently of the golf gloves 10. This would provide the opportunity for "custom" gloves to be sold at a fraction of the costs of having small runs of custom gloves. A standard glove may be made, and the ball markers may be custom made to provide a custom product. The ball markers 46 are preferably on the order of about one inch so that an identifiable representation may be provided on the upper surface 58 and/or the bar 62, if utilized.

While the invention has been described above with respect to certain embodiments thereof, it will be appreciated that variations and modifications may be made without departing from the spirit and scope of the invention. Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A golf glove comprising:

a palm portion and a back portion, said back portion having a first back section and a second back section;

a tab connected to the first back section and detatchably connectable to the second back section, said tab having an interior and an exterior surface, the tab having a first connector portion which cooperates with a second connector portion on the second back section, and the exterior surface located above a first recessed portion; and a ball marker having an upper surface, a lower surface, and a stud extending away from the lower surface, said stud at least assisting in securing the ball marker to the glove when attached and at least assisting in subsequent reconnection after disconnection from the golf glove, and said lower surface located below the exterior surface of the tab when the ball marker is connected to the glove.

2. The golf glove of claim 1 further comprising a socket located within said first recessed portion, said socket cooperating with said stud to secure the ball marker to the glove when the ball marker is connected to the glove.

3. The golf glove of claim 1 further comprising an insert located within the first recessed portion.

4. The golf glove of claim 3 wherein the insert is a rubber insert.

5. The golf glove of claim 4 wherein the insert further comprises a retainer surrounding the ball marker when the ball marker is connected to the glove.

6. The golf glove of claim 3 further comprising a retainer at least partially surrounding the ball marker when the ball marker is connected to the glove.

7. The golf glove of claim 1 wherein the ball marker further comprises:

a plug having an upper surface and a substantially planar lower surface defining a thickness therebetween;

a recess in the lower surface, said recess not extending the thickness of the plug;

a stud member having a base connected to an extending stud, said base having a thickness and an engaging surface; said base of said stud member located at least partially within said recess wherein the engaging surface of the base is substantially parallel to the bottom surface of the plug.

8. A ball marker comprising:

a plug having an upper surface and a substantially planar lower surface defining a thickness therebetween;

a recess in the lower surface, said recess not extending the thickness of the plug;

a stud member having a base connected to an extending stud, said base having a thickness and an engaging surface; said base of said stud member located at least partially within said recess wherein the engaging surface of the base is substantially parallel to the bottom surface of the plug.

9. The ball marker of claim 8 wherein said recess is formed by stamping.

10. The ball marker of claim 8 wherein the engaging surface of the base is substantially coplanar with said lower surface of said plug.

11. The ball marker of claim 8 wherein the base further comprises a perimeter, and the recess further comprises a perimeter, and the perimeter of said base is proximate to the perimeter of said recess.

12. The ball marker of claim 8 wherein the base of the stud member is soldered to said plug.

13. The ball marker of claim 8 wherein a portion of the plug is substantially cylindrical.

14. The ball marker of claim 8 wherein the upper surface of the plug is substantially planar with the lower surface of the plug.

15. The ball marker of claim 8 further comprising a bar extending from the upper surface of the plug.

16. The ball marker of claim 15 wherein the bar is formed in the shape of a logo.

17. The ball marker of claim 15 in combination with a golf glove comprising:

a palm portion and a back portion, said back portion having a first back section and a second back section;

a tab connected to the first back section and detatchably connectable to the second back section, said tab having an interior and an exterior surface, the tab having a first connector portion which cooperates with a second connector portion on the second back section, and the exterior surface located above a first recessed portion; wherein said stud of said ball marker at least assists in securing the ball marker to the glove when attached and at least assisting in subsequent reconnection after disconnection from the golf glove, and said lower surface is located below the exterior surface of the tab when the ball marker is connected to the glove.

18. A golf glove having a palm portion and a back portion; a selectively closeable connection on the back portion connecting a first back section to a second back section utilizing a tab connected to the first back section, said tab having a first connection portion which cooperates with a second connection portion on the second back section, the selectively closeable connection permitting the glove to receive a hand when the tab is not connected, and securing the glove on the hand when connected;

a well recessed into said tab, said well having an outer perimeter;

a socket connected to the tab within said well, a resilient insert around the socket in the well, and a ball marker having a stud receiveable within said well and into said socket.

19. The golf glove of claim 18 wherein the ball marker is further comprised of:

a plug having an upper surface and a substantially planar lower surface defining a thickness therebetween;

a recess in the lower surface, said recess not extending the thickness of the plug; and a stud member having a base connected to the stud, said base having a thickness and an engaging surface; said base of said stud member located at least partially within said recess wherein the engaging surface of the base is substantially parallel to the bottom surface of the plug.

20. The golf glove of claim 18 wherein the engaging surface of the base is substantially coplanar with the bottom surface of the plug.

* * * * *